United States Patent [19]

Claypool

[11] 3,982,675

[45] Sept. 28, 1976

[54] QUICK CHANGE PORTABLE POCKET

[75] Inventor: Dallas D. Claypool, Zanesville, Ohio

[73] Assignee: Raymond Lee Organization Inc., a part interest

[22] Filed: July 21, 1975

[21] Appl. No.: 597,656

[52] U.S. Cl. ..... 224/26 R; 224/2 B

[51] Int. Cl.[2] ..... A45C 1/04

[58] Field of Search ..... 224/5 R, 5 A, 5 C, 26 R, 224/26 B, 26 D, 26 H, 26 K, 2 C, 2 B, 3, 5 H, 5 D, 5 E, 5 G, 13, 17, 19, 21, 27, 25 R

[56] References Cited

UNITED STATES PATENTS 1,747,454 2/1930 Mees ..... 224/2 B 3,907,182 9/1975 Bryant ..... 224/2 B

*Primary Examiner*—Robert J. Spar

[57] ABSTRACT

A portable device is detachably securable to a belt worn about the waist of a user to provide an extra pocket. A pocket is formed on the inside surface of one elongated flap which is disposed inside the waist of the trousers. Another elongated flap carries on its inner surface means for engaging the bottom edge of the belt when the device is in use. A plate secured to the inner surface of both flaps at adjacent ends thereof and extending between the flaps carries means for detachably engaging the top edge of the belt when the device is in use.

3 Claims, 4 Drawing Figures

QUICK CHANGE PORTABLE POCKET

SUMMARY OF THE INVENTION

This invention is directed toward a portable device which can be detachably secured to the waist belt of a wearer to provide an extra readily accessible pocket which is disposed inside the waist of the trousers and which can be quickly and easily removed or replaced as required. A user can have several of said devices, each containing different items in the pocket for use under different circumstances whereby the user does not have to continually empty and fill the pockets of pants, jacket or the like with such items.

To this end, first and second elongated flexible flaps are disposed along a common line of elongation with one end of one flap being disposed adjacent one end of the other flap. Both flaps have outer and inner surfaces.

A plate is secured to the inner surfaces of both flaps at said adjacent ends and extends across the space between the flaps. Manually operable clip means secured to the plate are adapted to engage the top edge of the waist belt when the invention is in use.

Pocket forming means are secured to the inner surface of one flap. Belt engaging means secured to the inner surface of the other flap is adapted to engage the bottom edge of the belt when the invention is in use.

After the pocket is filled, the pocket carrying flap is disposed behind the belt and inside the trousers, with the inner surface adjacent the belt and the belt engaging means engaging the bottom edge of the belt. The clip means are then secured to the top edge of the belt. The other flap, with its inner surface adjacent the belt is then folded downward in front of the belt.

The two flaps can have cooperating detachably engagable clasp means to hold the flaps together when the invention is in use.

The invention can be easily removed from the belt for storage by reversing the process described above.

DETAILED DESCRIPTION OF PREFERRED EMBODIMENTS

Figure 1:
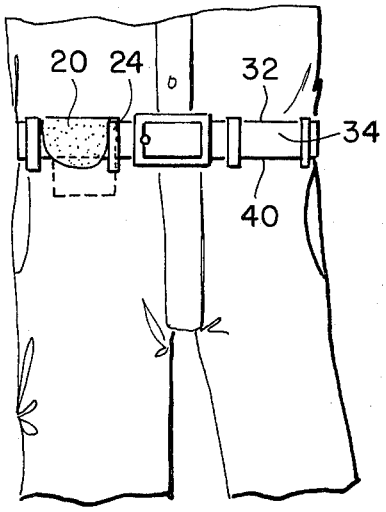
FIG. 1 shows the invention in use.
Figure 2:
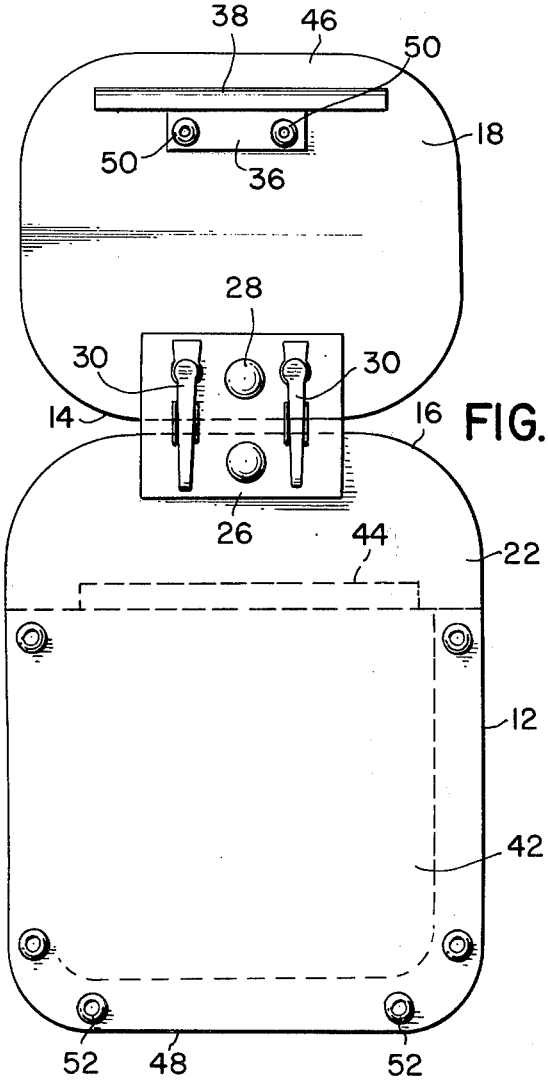
FIG. 2 is an unfolded plan view of the invention.
Figure 4:
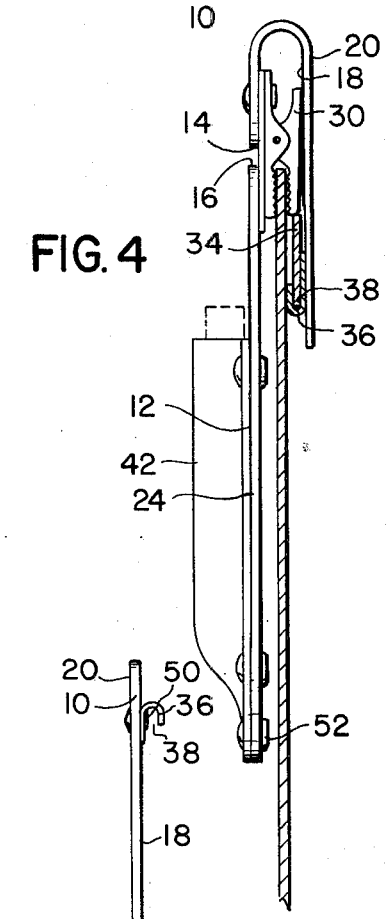
FIG. 4 is a view similar to FIG. 3 but showing the structure in folded position.
Figure 3:
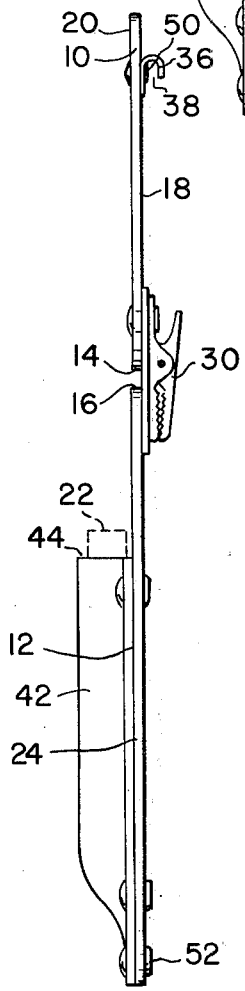
FIG. 3 is a side view of the structure shown in FIG. 2.

Referring now to FIGS. 1–4, first and second vertically elongated flexible flaps 10 and 12 generally rectangular with rounded ends are disposed in spaced position along a common vertical line of elongation with end 14 of flap 10 being disposed adjacent end 16 of flap 12. Flap 10 has inner surface 18 and outer surface 20. Flap 12 has inner surface 22 and outer surface 24. The flaps can be of leather, plastic, fabric or the like.

Rigid plate 26 of plastic, metal or the like is secured to the inner surfaces of both flaps adjacent ends 14 and 16 by rivets 28 or the like and spans the space between these ends. The exposed surface of plate 26 carries two vertically elongated metal manually operable vertical clips 30 with downwardly pointed jaws. These clips detachably engage the top edge 32 of belt 34 when the invention is in use.

Metal horizontally elongated member 36 having a groove 38 is secured to the inner surface of the flap 10 and is spaced from end 16 so that groove 38 can receive the bottom edge 40 of the belt when the invention is in use.

The member and clips can be secured in position by additional rivets 60.

Pocket forming means such as a suitably shaped member 42 of fabric, leather, plastic or the like having an opening 44 is also secured by rivets 52 or the like to the inner surface of flap 12. This flap is disposed inside the trousers as shown.

The invention can then be used as described.

Although the invention has been described with particular reference to the drawings, the protection sought is to be limited only by the terms of the claims which follow.

I claim:

1. A portable device detachably securable to a belt, said device comprising:

first and second elongated flexible flaps disposed in spaced apart position along a common line of elongation, one end of the first flap being disposed adjacent one end of the second flap, said flaps each having an outer surface and an inner surface;

a plate secured to each of said one ends on the inner surfaces of both flaps and spanning the space between said adjacent ends;

manually operable clip means secured to said plate and adapted to engage the top edge of said belt when the device is in use;

belt engaing means secured to the inner surface of the first flap and spaced from said plate, said belt means extending in a direction perpendicular to said line of elongation and adapted to engage the bottom edge of said belt when the device is in use; and pocket forming means secured to the outer surface of the second flap and spaced from said plate, the pocket forming means having an opening disposed adjacent said plate.

2. The device of claim 1 wherein said clip means includes two parallel clips extending side by side along said line of elongation.

3. The device of claim 2 wherein said belt engaging means is a curved member having a belt edge receiving groove.

* * * * *